US011047333B2

(12) United States Patent
Sato et al.

(10) Patent No.: US 11,047,333 B2
(45) Date of Patent: Jun. 29, 2021

(54) CYLINDER LINER, BLOCK MANUFACTURING METHOD AND CYLINDER LINER MANUFACTURING METHOD

(71) Applicants: TPR Co., Ltd., Tokyo (JP); TPR Industry Co., Ltd., Yamagata (JP)

(72) Inventors: Akira Sato, Sagae (JP); Koichi Hatakeyama, Sagae (JP)

(73) Assignees: TPR Co., Ltd., Tokyo (JP); TPR Industry Co., Ltd., Yamagata (JP)

( * ) Notice: Subject to any disclaimer, the term of this patent is extended or adjusted under 35 U.S.C. 154(b) by 0 days.

(21) Appl. No.: 16/546,437

(22) Filed: Aug. 21, 2019

(65) Prior Publication Data

US 2020/0063684 A1 Feb. 27, 2020

(30) Foreign Application Priority Data

Aug. 22, 2018 (JP) ..... JP2018-155214

(51) Int. Cl.
*F02F 1/16* (2006.01)
*F02F 1/14* (2006.01)
(Continued)

(52) U.S. Cl.
CPC ..... *F02F 1/16* (2013.01); *B22D 19/08* (2013.01); *F02F 1/004* (2013.01); *F02F 1/108* (2013.01); *F02B 75/18* (2013.01)

(58) Field of Classification Search
CPC ..... F02F 1/14; F02F 1/004; F02F 1/16; F02F 1/10; F01P 2003/021
See application file for complete search history.

(56) References Cited

U.S. PATENT DOCUMENTS 5,207,189 A * 5/1993 Kawauchi ..... F01P 3/02 123/41.79
5,251,578 A * 10/1993 Kawauchi ..... F02F 1/16 123/41.79
(Continued)

FOREIGN PATENT DOCUMENTS

CN 2900814 Y 5/2007
CN 209413997 U 9/2019
(Continued)

OTHER PUBLICATIONS

Notice of Reasons for Rejection in JP Application No. 2018-155214 dated Jun. 25, 2019, 3 pages.
(Continued)

*Primary Examiner* — Long T Tran
(74) *Attorney, Agent, or Firm* — Marshall, Gerstein & Borun LLP

(57) ABSTRACT

A cylinder liner that is casted in a block and defines a cylinder bore for one cylinder includes: a cylindrical liner body; a projection part including a plurality of projections on an outer peripheral surface of a part of the liner body; and a bore adjacent part inclined at a predetermined angle to an axial direction of the body and extending in the inclination direction, at a predetermined part between an upper side end and a lower side end of the body, of the outer peripheral surface of the body, which faces another cylinder bore to be adjacent when casted in the block. The outer peripheral surface of the bore adjacent part is positioned more on an inner side of the body than the outer peripheral surface above and below, and is formed such that the projections are absent on at least a part of the outer peripheral surface.

6 Claims, 10 Drawing Sheets

(51) Int. Cl.

| | |
|---|---|
| ***F02F 1/00*** | (2006.01) |
| ***B22D 19/08*** | (2006.01) |
| ***F02F 1/10*** | (2006.01) |
| *F02B 75/18* | (2006.01) |

(56) References Cited

U.S. PATENT DOCUMENTS

| | | | | |
|---|---|---|---|---|
| 7,000,584 | B1 * | 2/2006 | Wynveen | F02F 1/16 123/193.2 |
| 10,107,228 | B2 * | 10/2018 | Sharma | F02F 1/163 |
| 10,697,393 | B2 * | 6/2020 | Becker | F02F 1/16 |
| 2007/0209627 | A1 | 9/2007 | Bing et al. | |
| 2011/0114041 | A1 * | 5/2011 | Hamakawa | F02F 1/14 123/41.72 |
| 2017/0248097 | A1 * | 8/2017 | Maki | B21C 23/00 |

FOREIGN PATENT DOCUMENTS

| | | | |
|---|---|---|---|
| JP | 2002-070639 | A | 3/2002 |
| JP | 2002-097998 | A | 4/2002 |

OTHER PUBLICATIONS

Office Action in CN Application No. 201810960646.2 dated Feb. 25, 2021, 14 pages.

* cited by examiner

CYLINDER LINER, BLOCK MANUFACTURING METHOD AND CYLINDER LINER MANUFACTURING METHOD

CROSS-REFERENCE TO RELATED APPLICATIONS

This application is based upon and claims the benefit of prior Japanese Patent Application No. 2018-155214 filed on Aug. 22, 2018, the entire contents of which are incorporated herein by reference.

TECHNICAL FIELD

The present invention relates to a cylinder liner that defines a cylinder bore corresponding to one cylinder.

BACKGROUND OF THE INVENTION

A bore block in which a plurality of cylinder liners are cast in a multi-cylinder engine is disclosed in Patent document 1, for example. In the bore block, on a wall between cylinder bores, a drill path as a cooling water passage communicated with a water jacket around the cylinder bore is formed. Then, on an outer peripheral surface of each cylinder liner, a groove for increasing a distance between the outer peripheral surface of the cylinder liner and the drill path is formed in an annular shape over the entire circumferential direction. In addition, Patent document 2 that discloses a technique regarding the cylinder liner for casting refers to a technique of removing some of spines on the outer peripheral surface of the cylinder liner in order to suppress cracks on a cylinder block side when casting is performed in a state where a distance between the cylinder bores is short due to the spines provided on a liner surface to improve adhesion with a body side of the cylinder block. The spines are removed along a longitudinal direction of the cylinder liner using a machining tool such as an end mill.

CITATION LIST

Patent Documents

[Patent document 1] Japanese Patent Laid-Open No. 2002-70639

[Patent document 2] Japanese Patent Laid-Open No. 2002-97998

SUMMARY OF INVENTION

Technical Problem to be Solved by the Invention

Since before, in a multi-cylinder engine including a plurality of cylinder bores, compatibility of reduction of the engine size and effective cooling in each cylinder bore has been examined. Generally, when a pitch between the cylinder bores can be shortened, an entire length of the engine itself can be shortened, however, it becomes difficult to secure sufficient cooling space, that is, space for a cooling passage such as a water jacket for making cooling water flow, between the cylinder bores. Therefore, in a bore block illustrated in a conventional technique, by forming an annular groove on an outer peripheral surface of a cylinder liner, the space for the cooling passage is secured between the cylinder bores while shortening a distance between the cylinder bores.

However, in the cylinder liner that defines the cylinder bore corresponding to one cylinder, there is a case where projections are formed on a liner outer peripheral surface in order to improve adhesion with a block side during casting for manufacturing a cylinder block or a bore block or the like (simply referred to as "block", hereinafter). In such a case, when a surface of the cylinder liner is machined unnecessarily in a wide range, the number of projections for securing the adhesion is reduced with a risk of leading to a failure in the block.

The present invention is implemented in consideration of various circumstances described above, and the object is to provide a technique capable of compatibly cooling cylinder bores and reducing an inter-bore pitch while securing adhesion with a block when a cylinder liner is casted in a block to form a multi-cylinder engine.

Solution to Problem

In order to solve the problem, the applicant has determined to form, in a cylinder liner to be casted in a block, an area where projections for securing cooling space are absent in a limited range of an outer peripheral surface of a liner body, which faces another cylinder bore to be adjacent when casted. By such a configuration, cooling of the cylinder bores and reduction of an inter-bore pitch can be compatibly achieved while securing adhesion.

In more detail, the present invention is a cylinder liner that is casted in a block and defines a cylinder bore corresponding to one cylinder, and includes: a cylindrical liner body; a projection part provided so as to include a plurality of projections on an outer peripheral surface of a part of the liner body; and a bore adjacent part provided so as to be inclined at a predetermined angle to an axial direction of the liner body and to extend in the inclination direction, at a predetermined part between an upper side end and a lower side end of the liner body, of the outer peripheral surface of the liner body, which faces another cylinder bore to be adjacent when casted in the block. Then, the bore adjacent part is a groove formed such that the outer peripheral surface is positioned more on an inner side of the liner body than the outer peripheral surface above and below the bore adjacent part, and the projections are absent on at least a part of the outer peripheral surface. Note that the block of the present invention is an object that the liner is casted in, and is a bore block, a cylinder block or the like.

The cylinder liner of the present invention includes the projection part including the plurality of projections on the outer peripheral surface, and the bore adjacent part where the projections are absent on at least a part thereof, and the adhesion with the block when casted is secured by the projections provided on the projection part. A size, the number and density or the like of the projections can be appropriately set corresponding to the adhesion to be needed. The bore adjacent part is formed only at the predetermined part between the upper side end and the lower side end of the liner body, of the outer peripheral surface of the liner body, which faces the other cylinder bore to be adjacent when casted in the block. Therefore, decline of the adhesion of the cylinder liner and the block during casting due to formation of the bore adjacent part can be suppressed. Note that "the projections are absent" in the bore adjacent part indicates a state where the entire projections are absent. Thus, in the bore adjacent part, an area where "the projections are absent" is included in at least a part, and the projections may be entirely or partially present in the other area. As another method, the entire bore adjacent part may be in the state where "the projections are absent".

In addition, for the bore adjacent part, since the outer peripheral surface is positioned more on the inner side of the liner body than the outer peripheral surface above and below the bore adjacent part, even when the plurality of cylinder liners are casted in the block and a pitch between the cylinder bores is shortened, wider space between the bore adjacent part and the facing cylinder bore can be secured. Thus, when forming a passage for a cooling medium such as a drill path between the cylinder bores when casted, a diameter of the passage can be increased, so that more refrigerant can be distributed. In this way, according to the cylinder liner of the present invention, the cooling of the cylinder bores and the reduction of the inter-bore pitch can be compatibly achieved while securing the adhesion with the block.

Note that the groove as the bore adjacent part is not limited to one, and for example, the bore adjacent part may be configured by two grooves to be line symmetrical to each other when a center line of the liner body is a reference in a side view of the liner body. The bore adjacent part in that case may be formed in a shape of crossing the two grooves in a cross-hatch shape. Thus, time and labor of arranging the inclination direction of the grooves as the bore adjacent part in a specific direction when casting the liner body can be saved.

In addition, the cylinder liner may further include a positioning part provided so as to be at a predetermined relative position to the bore adjacent part such that the bore adjacent part is positioned at a predetermined position facing the other adjacent cylinder bore when casted in the block. In the cylinder liner of the present invention, when the state that the bore adjacent part faces the other adjacent cylinder bore when casted is not attained, the cooling space cannot be suitably formed between the outer peripheral surface of the liner body at the bore adjacent part and the other cylinder bore. Therefore, in the cylinder liner of the present invention, a relative positional relation of the cylinder liner to the block when casted is important. Then, the positioning part is provided so as to be at the predetermined relative position to the bore adjacent part. Since the bore adjacent part always has a predetermined positional relation to the positioning part, by utilizing the positioning part during casting, the relative positional relation of the cylinder liner to the block can be easily and surely turned to a desired state. Note that the predetermined relative position of the positioning part to the bore adjacent part is not limited to a specific form. It is preferable to adopt an appropriate relative positional relation so as to facilitate casting to the block.

Here, in the cylinder liner, the bore adjacent part may be provided in a pair at one side face part and the other side face part positioned on an opposite side of the one side face part across a center axis of the liner body, at the predetermined part between the upper side end and the lower side end of the liner body. Then, the positioning part may be provided on a part corresponding to at least one of the one side face part and the other side face part at the lower side end of the liner body. In this way, by providing the bore adjacent part in the pair at two parts on the outer peripheral surface between the upper side end and the lower side end of the cylinder liner, in particular, it is useful as the cylinder liner used in the case where the cylinder bores are formed in series in the block.

Note that "the part corresponding to the side face part at the lower side end of the liner body" means the part of which the relative positional relation with the side face part is determined at the lower side end of the liner body, and limitation to a specific part is not intended. Then, when the positioning part is provided corresponding to at least one of the paired bore adjacent parts, the paired bore adjacent parts can be surely positioned at the predetermined position during casting by utilizing the positioning part.

Here, in the cylinder liner, the positioning part may be provided in a pair at respective lower parts of the one side face part and the other side face part at the lower side end of the liner body. Further, the bore adjacent parts and the positioning parts may be provided such that a virtual line defined by connecting the bore adjacent parts provided in the pair and a virtual line defined by connecting the positioning parts provided in the pair cross at an angle of 0 degrees to 90 degrees in an upper view of the liner body. In order to define the virtual line, preferably center points of the paired bore adjacent parts are connected to each other or center points of the paired positioning parts are connected to each other. By arranging the bore adjacent parts and the positioning parts so that both have the predetermined relative positional relation, the positions of the bore adjacent parts are easily recognized when positioning is performed by the positioning parts, and casting work to the block is easily performed. Then, more preferably, the bore adjacent parts and the positioning parts are provided such that the virtual line defined by connecting the bore adjacent parts provided in the pair and the virtual line defined by connecting the positioning parts provided in the pair overlap in the upper view of the liner body, that is, that the crossing angle of both virtual lines becomes 0 degrees. In such a form, the bore adjacent parts and the positioning parts are lined in an axial direction of the liner body, and thus the casting work to the block is more easily performed.

For example, in the case of manufacturing a block for a multi-cylinder engine using the plurality of cylinder liners, the manufacturing method is as follows. That is, the manufacturing method includes: a step of positioning the plurality of cylinder liners on a predetermined straight line by bringing the positioning part of each of the plurality of cylinder liners into contact with a straight positioning shaft; a step of casting a body side of the block to the plurality of positioned cylinder liners; and a step of forming a passage where a cooling medium flows at a position held between the bore adjacent parts that the corresponding two cylinder liners respectively have, between the adjacent cylinder bores defined by the cylinder liners, in the body of the block after being casted. According to such a manufacturing method, since the bore adjacent part of each cylinder liner is positioned at the predetermined position just by bringing the positioning part of each cylinder liner into contact with the positioning shaft, burdens of the casting work to the block can be greatly reduced. Then, even when the passage where the cooling medium flows is formed at the block body formed by positioning and casting the cylinder liners in such a manner, interference of the passage and the cylinder liners can be suitably avoided.

Here, the present invention can be perceived from an aspect of a manufacturing method of the cylinder liner that is casted in the block and defines the cylinder bore corresponding to one cylinder. In that case, the manufacturing method includes: a step of casting a basic member of a cylindrical liner body including a plurality of projections on an outer peripheral surface; a step of providing a machining reference surface to the basic member of the liner body; a step of determining a first part at a predetermined part between an upper side end and a lower side end of the basic member, of the outer peripheral surface of the basic member of the liner body, which faces another cylinder bore to be adjacent when casted in the block, with the machining reference surface as a reference; and a step of cutting an outer surface of the basic member of the liner body corresponding to the first part, and forming a bore adjacent part by positioning the outer peripheral surface of the predetermined position more on an inner side of the liner body than the outer peripheral surface above and below the predetermined part and removing the projections on at least a part of the outer peripheral surface of the predetermined part. Technical ideas disclosed regarding the cylinder liner described above can also be applied to the manufacturing method of the cylinder liner in a range of not generating technical contradictions. According to the cylinder liner manufacturing method of the present invention, the first part where the bore adjacent part is to be formed is determined with the machining reference surface as the reference, and the bore adjacent part is formed at the first part by cutting the outer surface of the basic member of the liner body. Note that a machining method for the cutting is not limited to a specific method, and a cutting tool to be used is not limited to a specific tool either. The cylinder liner manufactured according to the manufacturing method makes it possible to, as described above, compatibly cool the cylinder bores and reduce the inter-bore pitch while securing the adhesion with the block.

In addition, the cylinder liner manufacturing method may further include: a step of determining a second part at the lower side end of the basic member of the liner body, to be a predetermined relative position to the bore adjacent part; and a step of cutting the basic member of the liner body corresponding to the second part in the radial direction, and forming a positioning part that positions the bore adjacent part at a predetermined position facing the other adjacent cylinder bore when casted in the block. The cylinder liner manufactured according to the manufacturing method makes it possible to, as described above, easily and surely turn the relative positional relation of the cylinder liner to the block to the desired state by utilizing the positioning part during casting.

Advantageous Effects of Invention

According to the present invention, when the cylinder liner is casted in the block, the cooling of the cylinder bores and the reduction of the inter-bore pitch can be compatibly achieved while securing the adhesion with the block.

DESCRIPTION OF EMBODIMENTS

Hereinafter, specific embodiments of the present invention will be described based on the drawings. Configurations described in the present embodiments do not mean to limit a technical range of the invention thereto unless described in particular.

First Embodiment

Figure 1A:
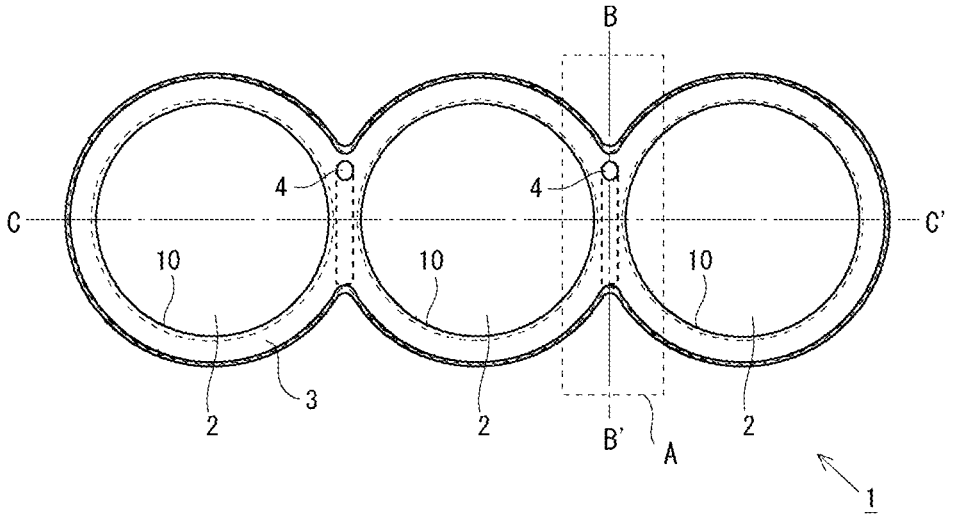
FIG. 1A is a top view of a bore block configured including a cylinder liner of the present invention.
Figure 1B:
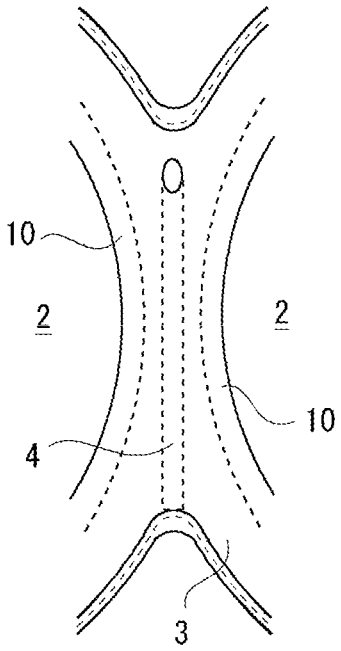
FIG. 1B is an enlarged view regarding a part (part A) of an upper surface of the bore block illustrated in FIG. 1A.
Figure 1C:
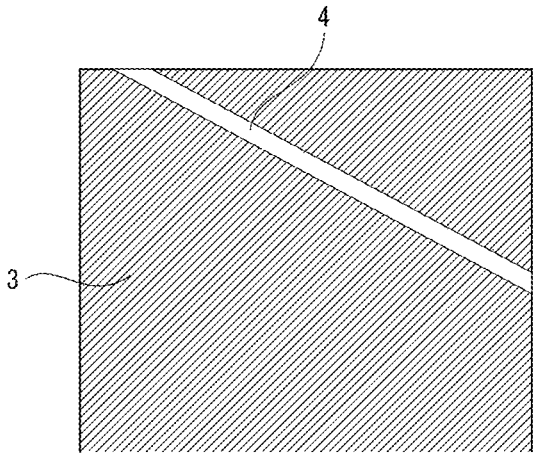
FIG. 1C is a B-B' sectional view of the bore block illustrated in FIG. 1A.
Figure 1D:
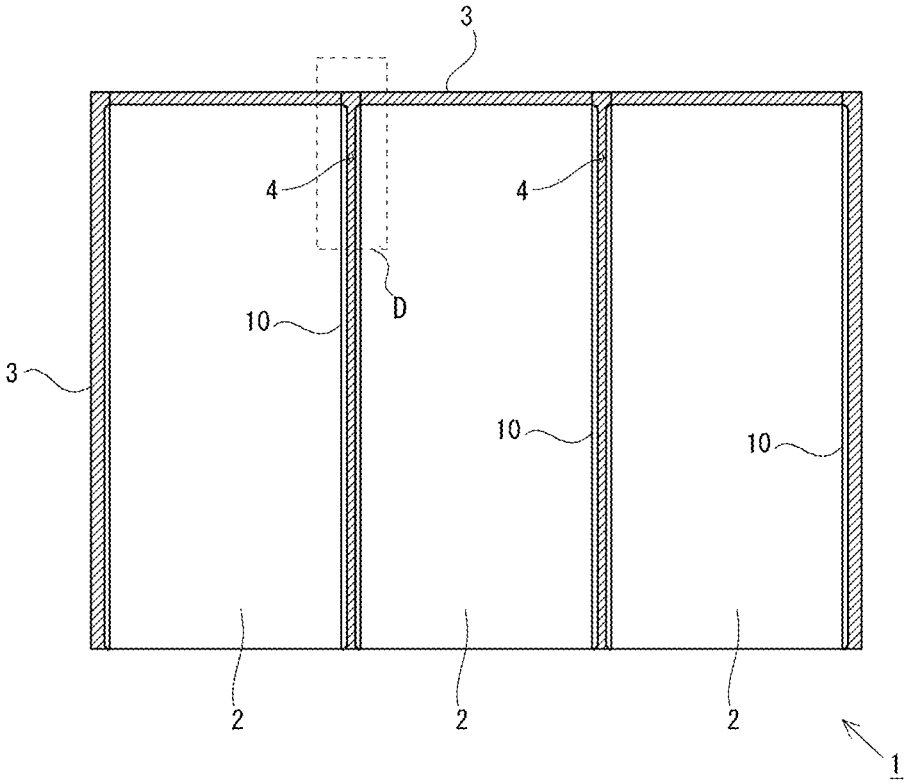
FIG. 1D is a C-C' sectional view of the bore block illustrated in FIG. 1A.

In FIG. 1A to FIG. 1D, a bore block 1 with a cylinder liner 10 of the present embodiment mounted thereon is illustrated. For details, FIG. 1A is a top view of the bore block 1, and FIG. 1B is an enlarged view in which a part (part A illustrated in FIG. 1A) between cylinder bores 2 that are adjacent in the bore block 1 is enlarged. In addition, FIG. 1C is a sectional view of the bore block 1 on a B-B' cross section illustrated in FIG. 1A, and FIG. 1D is a sectional view of the bore block 1 on a C-C' cross section illustrated in FIG. 1A. The bore block 1 is the configuration of a part of a cylinder block of an internal combustion engine, and the cylinder bore 2 corresponding to a cylinder of the internal combustion engine is defined by each cylinder liner 10. Note that, while the bore block 1 illustrated in the present embodiment has a form that three cylinder bores are arrayed in series, the cylinder liner 10 of the present embodiment can be applied also to the bore block 1 having other cylinder bore array forms.

A manufacturing method of the bore block 1 will be described later, and a structure of the bore block 1 will be described first. The bore block 1 is formed by casting three cylinder liners 10 by an aluminum alloy. The casted aluminum alloy forms a block body 3 of the bore block 1. Then, in the bore block 1, an inter-bore passage 4 is formed between the three cylinder bores 2 arrayed in series each other. An array direction (a crosswise direction in FIG. 1A and a direction of the C-C' cross section) of the cylinder bores is defined as a longitudinal direction of the bore block 1, and a direction orthogonal to it (that is, a vertical direction in FIG. 1A and a direction of the B-B' cross section) is defined as a front-back direction of the bore block 1. Then, the inter-bore passage 4 has a roughly columnar shape, extending in the front-back direction of the bore block 1 while being inclined downwards in an axial direction (height direction) of the cylinder bore 2 from an opening end provided on the upper surface (deck surface) of the bore block 1, as illustrated in FIG. 1B and FIG. 1C. The inter-bore passage 4 is formed by predetermined machining after the bore block 1 is casted and formed as described later. Then, though detailed illustrations are omitted, in the case where the bore block 1 is incorporated and a so-called cylinder block of an internal combustion engine is formed, a water jacket inside the cylinder block and the inter-bore passage 4 are connected to attain a passage where a cooling medium (cooling water or the like) can be distributed in the internal combustion engine after completion.

Note that, as a material of the block body 3 of the bore block 1, in consideration of weight reduction and costs, the aluminum alloy such as JIS ADC10 (reference standard: US ASTM A380.0) or JIS ADC12 (reference standard: US ASTM A383.0) can be adopted.

Figure 2A:
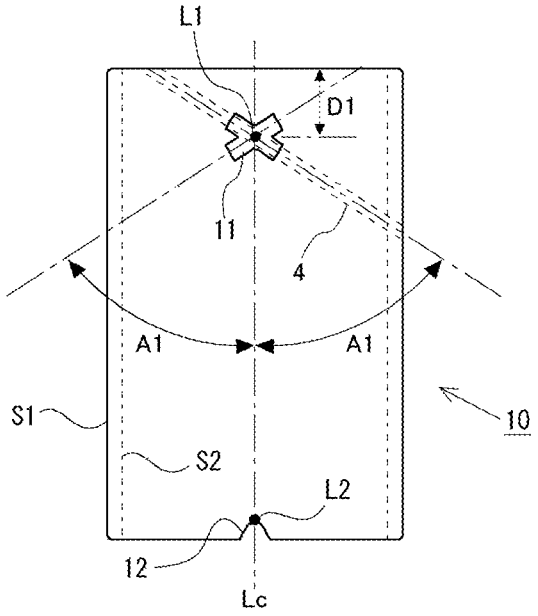
FIG. 2A is a view illustrating a side face of the cylinder liner of the present invention.
Figure 2B:
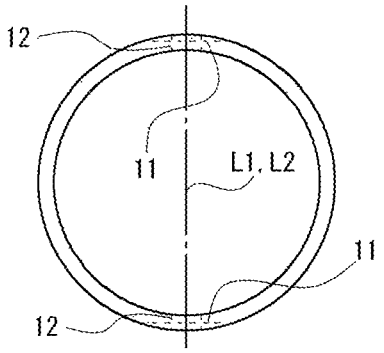
FIG. 2B is a view illustrating an upper surface of the cylinder liner of the present invention.
Figure 2C:
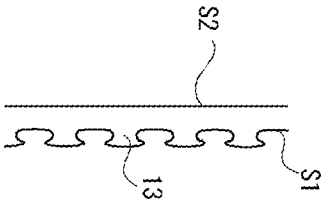
FIG. 2C is an enlarged view of an outer peripheral surface of the cylinder liner of the present invention.

Next, the cylinder liner 10 mounted on the bore block 1 will be described based on FIG. 2. FIG. 2A illustrates a side face of the cylinder liner 10, and FIG. 2B illustrates an upper surface of the cylinder liner 10. Further, FIG. 2C is an enlarged view of an outer peripheral surface S1 of the cylinder liner 10. The cylinder liner 10 has a cylindrical shape and is mounted on the bore block 1, and an inner peripheral surface S2 of the cylinder liner 10 forms a wall surface of the cylinder bore 2. Note that, as a material of the cylinder liner 10, in consideration of wear resistance, seize resistance and workability, cast iron such as JIS FC230 is used. One example of a composition of the cast iron is T. C: 2.9 to 3.7 (mass %, the same shall apply hereinafter), Si: 1.6 to 2.8, Mn: 0.5 to 1.0, P: 0.05 to 0.4 and the rest is Fe. As needed, Cr: 0.05 to 0.4 (mass %, the same shall apply hereinafter), B: 0.03 to 0.08, and Cu: 0.3 to 0.5 may be added.

Here, a plurality of projections 13 are formed on a large part of the outer peripheral surface S1 of the cylinder liner 10. Since the cylinder liner 10 is casted by the cast iron, the outer peripheral surface S1 is a casted surface. Since the projections 13 are formed on the outer peripheral surface S1, adhesion of the block body 3 and the cylinder liner 10 can be improved when casted by the aluminum alloy during manufacture of the bore block 1. FIG. 2C illustrates projections in a shape that a distal end has a larger diameter than a base as the projections 13 provided on the outer peripheral surface S1, however, the shape of the projections 13 is not limited thereto. For example, the shape such as a trapezoid or a quadrangle can be adopted.

In addition, a dimension and a distribution of the projections 13 on the outer peripheral surface S1 can be set in consideration of the adhesion of the block body 3 and the cylinder liner 10 in the bore block 1. For example, a height of the projections 13 is 0.2 to 0.7 mm, and the number of the projections is 10 to 100 pieces per $cm^2$. Also, it is desirable that a projection area ratio is 10 to 50%. The projection area ratio is calculated as a ratio occupied in a unit area by a total area of cross sectional areas of the projections 13 at the position of 0.2 mm from the base of the projections 13 in the projections 13 present within the unit area. When the projection area ratio is lower than 10%, bond strength of the block body 3 and the cylinder liner 10 declines. On the other hand, when the projection area ratio exceeds 50%, since decline of castability due to joining of the projections is invited, a gap is formed, the adhesion declines, and heat conductivity declines. Note that a distribution of the projections 13 described above is a numerical value on the outer peripheral surface S1 of the cylinder liner 10 excluding a groove part 11 to be described later.

Here, the groove part 11 will be described. For the groove part 11, differently from the outer peripheral surface S1 of the cylinder liner 10 excluding the groove part 11, the projections 13 described above are not formed on the surface. Further, the groove part 11 is provided on a position facing the other cylinder bore 2 to be adjacent to the cylinder bore 2 with the cylinder liner 10 mounted thereon when the cylinder liner 10 is casted in the bore block 1. Specifically, the groove part 11 is provided on a predetermined part between an upper side end and a lower side end of the cylinder liner 10, of the outer peripheral surface which faces the other cylinder bore 2 to be adjacent to the cylinder bore 2 with the cylinder liner 10 mounted thereon when the cylinder liner 10 is casted in the bore block 1. The "predetermined part" here is the position on the outer peripheral surface separated downwards by a predetermined distance D1 from the upper side end of the cylinder liner 10. Then, the groove part 11 in the present example has a shape of crossing two roughly rectangular grooves in a cross-hatch shape, in a side view of the cylinder liner 10 (as illustrated in FIG. 2A). Of the two grooves configuring the groove part 11, one groove is formed such that the axial direction of the groove in the side view of the cylinder liner 10 is inclined by a predetermined angle A1 to the axial direction of the cylinder liner 10. In addition, of the two roughly rectangular grooves, the other groove is formed so as to be line symmetrical with the one groove when a center line Lc of the cylinder liner 10 is a reference, in the side view of the cylinder liner 10. The groove part 11 having the above-described shape is provided at two parts on the outer peripheral surface of the cylinder liner 10 so as to be a pair across the center axis of the cylinder liner 10. That is, in an upper view of the cylinder liner 10 as illustrated in FIG. 2B, the groove part 11 is provided at two parts on the outer peripheral surface of the cylinder liner 10 so as to be the pair across a center of the cylinder liner 10. Then, since the groove part 11 is formed by cutting, from a basic member of the cylinder liner 10 originally in a cylindrical shape, the outer peripheral surface of the basic member corresponding to the part where the groove part 11 is to be formed as described later, the outer peripheral surface of the groove part 11 is positioned more on an inner side of the cylinder liner 10 than the outer peripheral surface S1 of the cylinder liner 10 positioned above and below the groove part 11. That is, a surface of the groove part 11 is at a position one stage lower than the outer peripheral surface S1 of the cylinder liner 10 in a radial direction of the cylinder liner 10 in the upper view. From the above, the groove part 11 corresponds to a bore adjacent part of the present invention, and the outer peripheral surface S1 of the cylinder liner 10 other than the groove part 11 corresponds to a projection part of the present invention. Note that, while the groove part 11 is in the state where the projections 13 are generally removed and are absent on the surface by being formed by cutting the basic member of the cylinder liner 10 as described above, a condition where some projections 13 are partially removed and only the base part remains, for example, is possible depending on the machining state. That is, for the groove part 11, it is sufficient when the projections 13 are completely removed in at least a part thereof, and it is not necessary that the projections 13 are completely removed in the whole.

Figure 3:
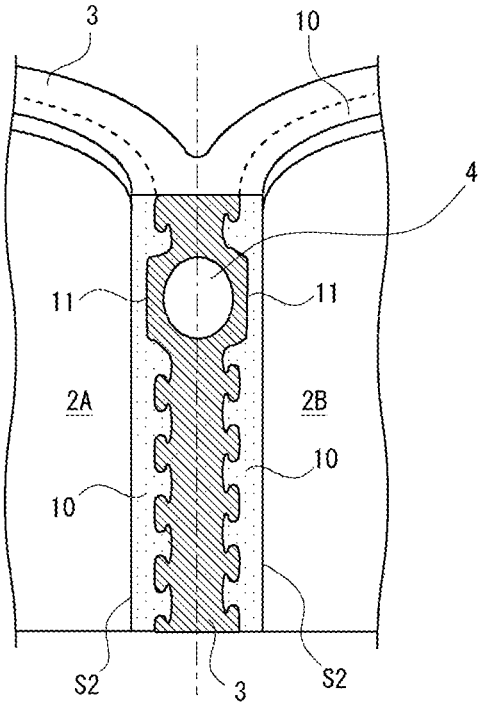
FIG. 3 is an enlarged view of a part (part D) of a bore block cross section illustrated in FIG. 1D.

Since the groove part 11 is provided in the cylinder liner 10 in this way, in the case where the cylinder liner 10 is casted in the bore block 1, the configuration between the adjacent cylinder bores is as illustrated in FIG. 3. FIG. 3 is an enlarged view of part D (the part held between the adjacent cylinder bores 2) on the cross section of the bore block 1 illustrated in FIG. 1D. The part D is also the part including the inter-bore passage 4.

As described above, the groove part 11 is arranged so as to face the adjacent cylinder bore 2. Thus, the inter-bore passage 4 arranged between the adjacent cylinder bores 2 is in the state of being held between the groove part 11 of the cylinder liner 10 on the side of one cylinder bore 2 and the groove part 11 of the cylinder liner 10 on the side of the other cylinder bore 2. Here, since the surface of the groove part 11 is at the position lower than the outer peripheral surface S1 above and below, that is, distal ends of the projections 13, between the groove parts 11 facing each other, space for forming the inter-bore passage 4 is easily secured. In other words, interference of the inter-bore passage 4 and the cylinder liner 10 can be avoided, and the state where the block body 3 is interposed more between the cylinder liner 10 and the inter-bore passage 4 is easily established. This makes it possible to increase a passage diameter (passage cross-sectional area) of the inter-bore passage 4 even while reducing a pitch between the cylinder bores 2, and suitably cool the cylinder liner 10 inside each cylinder bore 2. Note that, in the example illustrated in FIG. 3, the surface of the groove part 11 is formed by the surface parallel to an inner wall surface of the cylinder liner 10, however, the surface of the groove part 11 does not need to be parallel to the inner wall surface of the cylinder liner 10, and the shape of the surface of the groove part 11 can be appropriately set as long as the interference of the inter-bore passage 4 and the cylinder liner 10 can be avoided.

Here, a dimension of the groove part 11 will be mentioned. First, the predetermined distance D1 for specifying the position of the groove part 11 in the axial direction of the cylinder liner 10 is determined such that the groove part 11 is arranged at the position closest to the inter-bore passage 4, of the outer peripheral surface of the cylinder liner 10 facing the adjacent cylinder bore 2. In addition, the inclination angle A1 of the two grooves configuring the groove part 11 is set to be equal to the inclination angle of the inter-bore passage 4. Note that the position and the inclination angle of the inter-bore passage 4 are determined in consideration of the position of a combustion chamber to be formed when a piston inside the cylinder bore is positioned at a top dead center, when the cylinder block is formed including the bore block 1 and the engine is configured further. That is, the position and the inclination angle of the inter-bore passage 4 are determined corresponding to the part which is exposed to an environment of a relatively high temperature and especially needs cooling by the cooling medium in the cylinder liner 10. In addition, as illustrated in FIG. 3, corresponding to the passage diameter of the inter-bore passage 4 for cooling the cylinder bore 2, that is, to suitably transmit heat to the inter-bore passage 4, a width and depth of each groove configuring the groove part 11 are determined. If the width of each groove is determined to be unnecessarily large to the passage diameter of the inter-bore passage 4, since an area where the projections 13 are formed on the outer peripheral surface S1 of the cylinder liner 10 becomes small, the adhesion of the cylinder liner 10 and the block body 3 can be undesirably affected. Therefore, it is preferable that the width of each groove configuring the groove part 11 is determined from viewpoints of avoiding the interference with the inter-bore passage 4 and securing the adhesion.

In addition, it is preferable that the depth of each groove configuring the groove part 11 is determined from the viewpoints of avoiding the interference with the inter-bore passage 4 and securing the strength of the cylinder liner 10. If the depth of each groove is set unnecessarily large, since a thickness of the cylinder liner 10 at the part corresponding to the groove part 11 is reduced, the strength of the cylinder liner 10 declines. Also, when the depth of each groove is set unnecessarily small, a distance by which the groove part 11 is positioned more on the inner side of the cylinder liner 10 than the outer peripheral surface S1 above and below is reduced as a result, and it becomes difficult to sufficiently avoid the interference with the inter-bore passage 4. Thus, problems regarding avoidance of the interference with the inter-bore passage 4 and securing of the strength of the cylinder liner 10 are taken into consideration and the depth of each groove configuring the groove part 11 is determined.

Next, a positioning groove 12 (corresponding to a positioning part of the present invention) used to make the groove part 11 face the other adjacent cylinder bore 2 will be described. The positioning groove 12 is formed at the lower side end of the cylinder liner 10, right below a center part of the groove part 11, as illustrated in FIG. 2A. Then, for a relative positional relation of the groove part 11 and the positioning groove 12, the respective positions of both are determined such that a virtual line L1 defined by mutually connecting the center parts of the paired groove parts 11 provided at two parts on the outer peripheral surface of the cylinder liner 10 and a virtual line L2 defined by mutually connecting the center parts of the paired positioning grooves 12 provided on the lower side end overlap in the upper view of the cylinder liner 10. By such a configuration, when the position of the cylinder liner 10 in the bore block 1 is determined based on the positioning groove 12, the position of the groove part 11 is also determined at the predetermined position with the positioning groove 12 as the reference. More specifically, since the virtual lines L1 and L2 overlap as described above, when the position of the cylinder liner 10 is determined using the paired positioning grooves 12, the positions of the paired groove parts 11 are also determined so as to be lined with the paired positioning grooves 12.

In addition, as a different method, instead of the form that the virtual line L1 and the virtual line L2 overlap, the respective positions of the paired groove parts 11 and the paired positioning grooves 12 may be determined such that the virtual line L1 and the virtual line L2 cross at an angle of 0 degrees to 90 degrees in the upper view. It is important that the relative positional relation of the virtual line L1 and the virtual line L2 is determined to be a predetermined relation. Also by such a configuration, when the position of the cylinder liner 10 in the bore block 1 is determined based on the positioning groove 12, the position of the groove part 11 is also determined to be the predetermined position, that is, the position suitably facing the adjacent cylinder bore.

<Manufacturing Method of Cylinder Liner 10>

The cylinder liner 10 is manufactured by a centrifugal casting method. According to the centrifugal casting method, the cylinder liner 10 including the plurality of uniform projections 13 on the outer peripheral surface S1 can be manufactured with excellent productivity. Hereinafter, the manufacturing method of the cylinder liner 10 will be described based on FIG. 4.

First, in S101, the basic member of the cylinder liner 10 is casted. The basic member is a cylindrical structure including the outer peripheral surface S1 where the projections 13 are formed. As one example, a coating agent is prepared by mixing diatomaceous earth having an average grain diameter of 0.002 to 0.02 mm, bentonite (binder), water and a surfactant by a predetermined ratio. The coating agent is sprayed and applied to an inner surface of a mold (die) which is heated to 200 to 400° C. and rotated, and a coating layer is formed on the inner surface of the mold. The thickness of the coating layer is 0.5 to 1.1 mm. By an effect of the surfactant, a plurality of recessed holes are formed in the coating layer by bubbles of steams generated from inside of the coating layer. After the coating layer is dried, molten cast iron is casted inside the rotated mold. At the time, the molten metal is filled in the recessed holes of the coating layer, and the plurality of uniform projections are formed.

After the molten metal is solidified and the cylinder liner 10 is formed, the cylinder liner 10 is taken out from the mold together with the coating layer. The coating agent is removed by blasting, and the basic member of the cylinder liner 10 including the plurality of uniform projections 13 on the outer peripheral surface is manufactured.

Next, in S102, to the basic member of the cylinder liner 10, the machining reference surface is provided. Specifically, an end face at the lower side end of the cylinder liner 10, where the positioning groove 12 is to be formed, is cut and formed as the machining reference surface. Subsequently, in S103, cutting parts where the groove parts 11 and the positioning grooves 12 are to be formed are determined. For the positioning grooves 12, the two positions across the center axis of the cylinder liner 10 at the lower side end of the cylinder liner 10 are determined as the cutting parts (corresponding to a second part of the present invention) of the positioning grooves 12. A straight line connecting the cutting parts of the two positioning grooves 12 corresponds to the virtual line L2, and crosses with the center axis of the cylinder liner 10. In addition, while the groove part 11 is formed to be the pair at two parts on the outer peripheral surface separated downwards by the predetermined distance D1 from the upper side end of the cylinder liner 10, for the paired groove parts 11, the two positions on the outer peripheral surface across the center axis of the cylinder liner 10 are determined as the cutting parts of the groove parts 11 (corresponding to the first part of the present invention). Further, a straight line connecting the cutting parts of the two groove parts 11 corresponds to the virtual line L1, and as described above, the cutting parts of the groove parts 11 are determined so as to overlap with the virtual line L2 in the upper view of the cylinder liner 10.

Then, in S104, the groove parts 11 are formed by cutting the surface of the basic member of the cylinder liner 10 so as to form the grooves for which the two grooves that have the width and depth determined as described above and are inclined by the predetermined angle A1 to the axial direction of the basic member of the cylinder liner 10 are crossed in the cross-hatch shape at the cutting parts on the outer peripheral surface determined in S103. Then, in S105, the positioning grooves 12 are formed by cutting the basic member of the cylinder liner 10 in the radial direction (the direction from the outer peripheral surface S1 to the inner peripheral surface S2) at the cutting parts at the lower side end determined in S103. The shape of the positioning groove 12 is not limited to a specific shape as long as the cylinder liner 10 can be positioned in a manufacturing process of the bore block 1. For example, the positioning groove 12 may be an appropriately rounded recess as illustrated in FIG. 2A so that a positioning jig is fitted.

Figure 4:
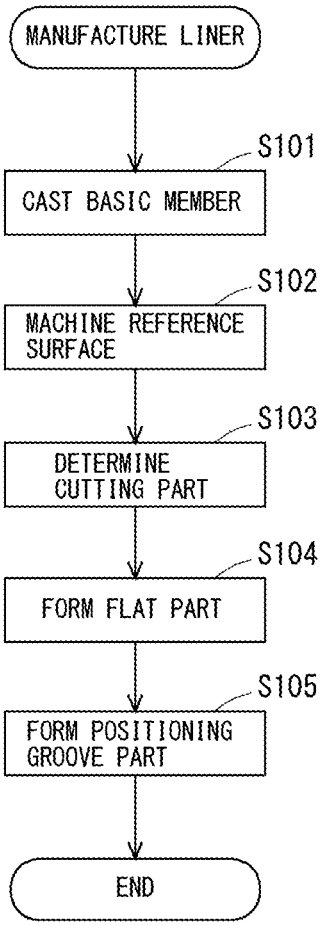
FIG. 4 is a diagram illustrating a flow of manufacture of the cylinder liner of the present invention.

Note that the manufacturing method of the cylinder liner 10 is not limited to the method illustrated in FIG. 4. For example, the positioning groove 12 may be formed in advance and the groove part 11 may be formed thereafter. Also in this case, the relative positional relation between the positioning groove 12 and the groove part 11 described above, that is, overlap of the virtual lines L1 and L2 in the upper view, is taken into consideration.

<Manufacturing Method of Bore Block 1>

Figure 5:
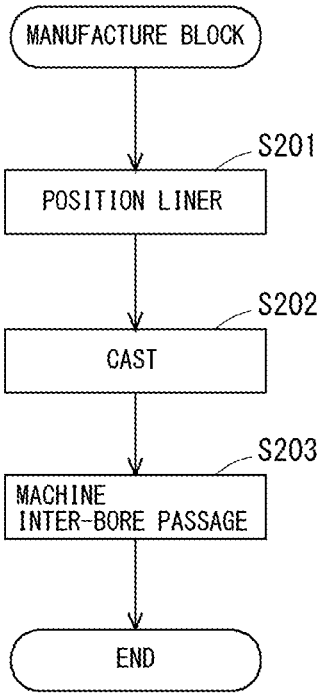
FIG. 5 is a diagram illustrating a flow of manufacture of the bore block configured including the cylinder liner of the present invention.

The manufacturing method of the bore block 1 illustrated in FIG. 1A or the like using the cylinder liner 10 manufactured according to the above-described method will be described based on FIG. 5. First, in S201, inside the mold for the bore block 1, the cylinder liners 10 for the number according to the number of the cylinder bores to be formed there are positioned (in the present embodiment, the three cylinder liners 10 are positioned). Specifically, using the positioning groove 12 provided on the lower side end of each cylinder liner 10, the three cylinder liners 10 are positioned. A jig for positioning is a straight positioning shaft. By fitting the respective positioning grooves 12 of the three cylinder liners 10 to the positioning shaft, the three cylinder liners 10 can be positioned on a straight line. At the time, the groove parts 11 of the respective cylinder liners 10 are also lined on a straight line along the positioning shaft. Then, since the positioning shaft is positioned to the mold along the longitudinal direction of the bore block 1, when the cylinder liners 10 are positioned by the positioning shaft, the respective groove parts 11 are placed in the state of facing the adjacent cylinder bores.

Now, when the respective cylinder liners 10 are positioned just by fitting the positioning grooves 12 of the respective cylinder liners 10 to the positioning shaft, that is, when the positions of the two groove parts 11 in the respective cylinder liners 10 are determined without taking the inclination direction of the inter-bore passage 4 into consideration, it is concerned that the relative positions of the inter-bore passage 4 and the groove parts 11 are not the relative positions effective for solving the problems regarding the avoidance of the interference with the inter-bore passage 4, the securing of the adhesion with the bore block 1 and the securing of the strength of the cylinder liners 10 as described above. However, the groove part 11 in the present embodiment is configured by crossing the two roughly rectangular grooves to be line symmetrical to each other with the center line Lc of the cylinder liner 10 as the reference in the cross-hatch shape in the side view of the cylinder liner 10, as described in the description of FIG. 2A above. Therefore, even in the case where the respective cylinder liners 10 are positioned without taking the positions of the two groove parts 11 in the respective cylinder liners 10 into consideration, that is, even in the case where the positions of the two groove parts 11 in the cylinder liner 10 are inverted, the relative positions of the inter-bore passage 4 and the groove parts 11 can be the relative positions effective for solving the problems regarding the avoidance of the interference with the inter-bore passage 4, the securing of the adhesion with the bore block 1 and the securing of the strength of the cylinder liners 10 as illustrated in FIG. 3 described above.

Next, when the three cylinder liners 10 are positioned inside the mold in S201, in S202, by a molten aluminum alloy to form the block body 3 being filled inside the mold, the cylinder liners 10 are casted and a basic structure of the bore block 1 is formed. Then, in S203, to the basic structure, boring for forming the inter-bore passage 4 is performed. The boring at the time is performed along the front-back direction of the basic structure at the angle inclined downward by the predetermined angle A1 in the axial direction of the cylinder bore 2 from the position of the opening end set on the upper surface of the basic structure. Thus, as illustrated in FIG. 3 described above, the inter-bore passage 4 is formed in the form of passing through the part held between the groove part 11 of the cylinder liner 10 on the side of one cylinder bore 2 and the groove part 11 of the cylinder liner 10 on the side of the other cylinder bore 2, of a wall part of the bore block 1 formed between the adjacent cylinder bores 2. In addition, in S203, finishing of the inner peripheral surface S2 of the cylinder liner 10 is also performed. After machining is ended, the thickness of the cylinder liner 10 is 1.0 to 2.5 mm, for example.

In such a manufacturing method of the bore block 1, even in the case where the inter-bore passage 4 is bored after casting, as illustrated in FIG. 3, the groove parts 11 of the cylinder liners 10 are arranged so as to face each other at the part where the bored part and the outer peripheral surface of the cylinder liner 10 are the closest, the interference of the inter-bore passage 4 and the cylinder liner 10 can be suitably avoided. Such a configuration of the cylinder liner 10 is particularly useful in the case of reducing the inter-bore pitch of the bore block 1. In addition, since the formation part of the groove part 11 in the cylinder liner 10 is limited to the range of facing the other adjacent cylinder bore 2, unnecessary decline of the adhesion of the cylinder liner 10 and the block body 3 after casting can be avoided.

<Modification 1>

In the above-described cylinder liner 10, the groove part 11 is provided in the pair at two parts on the outer peripheral surface of the cylinder liner 10, however, the groove part 11 may be provided at only one part on the outer peripheral surface instead of the form. For example, of the three cylinder bores 2 formed in the bore block 1 illustrated in FIG. 1A or the like, for the cylinder bore 2 positioned at an end on a right side or a left side, the other adjacent cylinder bore is positioned only on the left or right. For the cylinder liner 10 included in such a cylinder bore 2, even when only one groove part 11 is provided, there is no problem when the groove part 11 is arranged so as to face the other adjacent cylinder bore 2.

In addition, it is not necessary to provide the positioning groove 12 in the pair at the lower side end of the cylinder liner 10, and when the cylinder liner 10 can be positioned at the predetermined position where the groove part 11 faces the other adjacent cylinder bore 2 inside the mold in an interaction with the jig for positioning, the number and the shape of the positioning grooves 12 are not limited specifically. Further, the arrangement at the lower side end of the positioning groove 12 does not need to be right below the groove part 11, and is not limited to a specific position when the cylinder liner 10 can be positioned at the predetermined position inside the mold as described above.

Figure 6:
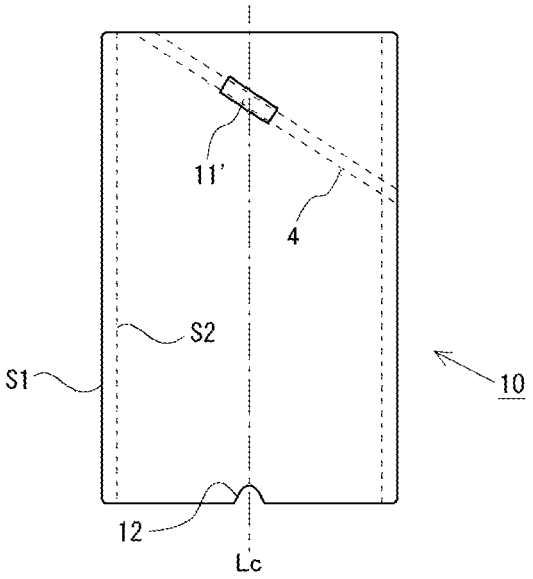
FIG. 6 is a view illustrating another configuration example of a groove part.

Further, the groove part 11 does not need to be the shape of crossing the two roughly rectangular grooves in the cross-hatch shape, and even in the case where the positions of the two groove parts 11 in the cylinder liner 10 are mutually inverted, the shape of the groove part 11 is not limited specifically when it is such a shape that the inter-bore passage 4 can pass between the groove parts 11 facing each other. Note that, when work of determining the positions of the two groove parts in the cylinder liner 10 in consideration of the inclination direction of the inter-bore passage 4 is additionally performed when positioning the cylinder liner 10 inside the mold for the bore block 1, the shape of the groove part may be configured only by one roughly rectangular groove parts 11' having the same inclination angle as the inter-bore passage 4 as illustrated in FIG. 6.

<Modification 2>

Figure 7:
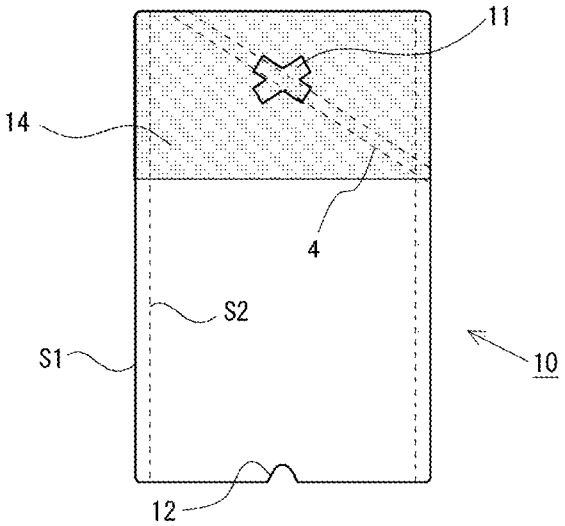
FIG. 7 is a view illustrating a side face of the cylinder liner provided with a high-heat conductive film.

Of the outer peripheral surface of the cylinder liner 10, at least on the groove part 11 and the peripheral part, a high-heat conductive film 14 may be provided. For example, as illustrated in FIG. 7, the high-heat conductive film 14 may be provided in the range from the upper side end to an intermediate part in the axial direction of the cylinder liner 10, of the outer peripheral surface of the cylinder liner 10. The high-heat conductive film 14 is provided over an entire circumferential direction of the cylinder liner, including the surface of the groove part 11 and the projections 13. Note that, in the example illustrated in FIG. 7, a lower end of the high-heat conductive film 14 in the axial direction of the cylinder liner 10 is positioned below the lower end of the groove part 11, however, the lower end of the high-heat conductive film 14 may be determined so as to be at the position equal to the lower end of the groove part 11. In short, it is sufficient when the high-heat conductive film 14 is formed at the part including the groove part 11 and the periphery and the part that easily receives heat generated inside the cylinder bore 2 when the internal combustion engine is operated, of the outer peripheral surface of the cylinder liner 10.

Here, the high-heat conductive film 14 is formed by a material capable of improving heat conductivity between the cylinder liner 10 and the block body 3 compared to the state where the high-heat conductive film 14 is not formed. Specifically, the high-heat conductive film 14 is configured by a sprayed layer of aluminum, the aluminum alloy (an Al—Si alloy, an Al—Si—Cu alloy, an Al—Cu alloy or the like), copper or a copper alloy. Note that as the material of the sprayed layer, the material other than the ones described above can be used when it is the material satisfying at least one of conditions (A) and (B) below.

(A) The material having a melting point at or below a molten metal temperature of a casting material of the block body 3, or the material containing such a material. The "molten metal temperature" here is the temperature of the molten metal of the casting material to be filled inside the mold when casting the cylinder liner 10 by the casting material of the block body 3.

(B) The material to be metallurgically bonded with the casting material of the block body 3, or the material containing such a material.

When the cylinder liner 10 is casted in the block body 3 in the state where the high-heat conductive film 14 is formed on the outer peripheral surface at an upper part of the cylinder liner 10, the upper part of the cylinder liner 10 and the block body 3 are bonded through the high-heat conductive film 14. The bond strength and the adhesion at the time become higher than that in the case where the upper part of the cylinder liner 10 and the block body 3 are bonded without interposing the high-heat conductive film 14. When the adhesion of the upper part of the cylinder liner 10 and the block body 3 is improved in such a manner, the heat conductivity between the upper part of the cylinder liner 10 and the block body 3 is improved. In particular, in the configuration that the groove part 11 is provided on the upper part of the cylinder liner 10, it is possible that the bond strength, the adhesion and the heat conductivity between the cylinder liner 10 and the block body 3 at the groove part 11 and the periphery decline since the projections 13 are not formed at the groove part 11, however, the decline of the bond strength, the adhesion and the heat conductivity between the cylinder liner 10 and the block body 3 due to provision of the groove part 11 can be suppressed by bonding the groove part 11 and the peripheral part with the block body 3 through the high-heat conductive film 14.

<Manufacturing Method of Cylinder Liner 10>

Figure 8:
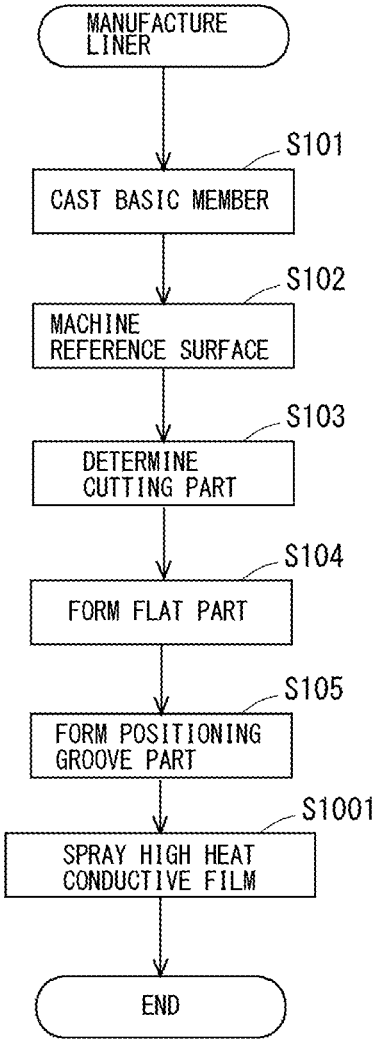
FIG. 8 is a diagram illustrating a flow of manufacture of the cylinder liner provided with the high-heat conductive film.
Figure 9:
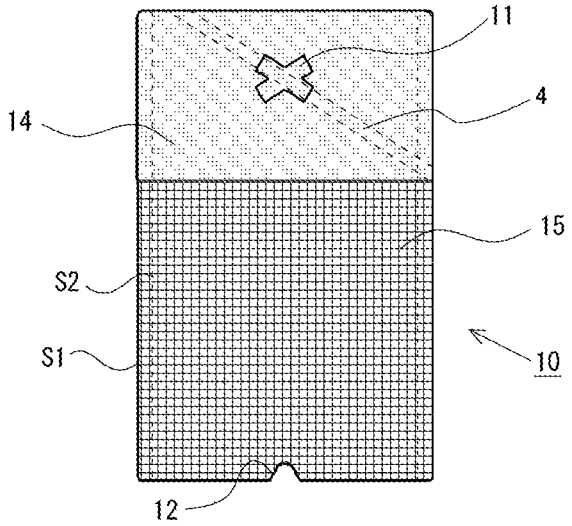
FIG. 9 is a view illustrating a side face of the cylinder liner provided with the high-heat conductive film and a low-heat conductive film.

Hereinafter, based on FIG. 8, the manufacturing method of the cylinder liner 10 in the present modification will be described. In FIG. 8, same symbols are attached to processes similar to the ones in FIG. 4 above.

In the example illustrated in FIG. 8, after the process of S105 is ended, the process of S1001 is performed. In the process of S1001, the high-heat conductive film 14 is formed by plasma spraying, arc spraying or HVOF spraying of the aluminum, the aluminum alloy, the copper, the copper alloy or the like in the range from the upper side end to the intermediate part in the axial direction, of the outer peripheral surface of the cylinder liner 10. The "intermediate part"

at the time is determined, as described above, as the position equal to the lower end of the groove part 11 in the axial direction of the cylinder liner 10 or the position below the lower end and the position capable of covering the outer peripheral surface at the part that easily receives the heat generated inside the cylinder bore 2 when the internal combustion engine is operated with the high-heat conductive film 14. In addition, the thickness of the high-heat conductive film 14 is determined such that a recess formed between the adjacent projections 13 is not filled by the high-heat conductive film 14. That is, the thickness of the high-heat conductive film 14 is determined so as to obtain an anchor effect by the projections 13 by the casting material of the block body 3 flowing into the recess when the cylinder liner 10 is casted by the casting material of the block body 3.

Note that, while the example that the high-heat conductive film 14 is formed by spraying is described in the present modification, the high-heat conductive film 14 may be formed by shot coating or plating. In the case of forming the high-heat conductive film 14 by shot coating, as the material of the high-heat conductive film 14, zinc, tin, aluminum, an alloy containing at least one of the zinc and the tin or the like can be used. In shot coating, since the high-heat conductive film 14 can be formed without melting the coating material, the oxide is not easily contained inside the high-heat conductive film 14. Thus, the decline of the heat conductivity of the high-heat conductive film 14 due to the oxide being contained can be suppressed. In the case of forming the high-heat conductive film 14 by plating, as the material of the high-heat conductive film 14, the aluminum, the aluminum alloy, the copper, the copper alloy or the like can be used.

In addition, while the example that only the high-heat conductive film 14 is provided on the outer peripheral surface of the cylinder liner 10 is described in the present modification, a low-heat conductive film 15 may be provided in addition to the high-heat conductive film 14. Specifically, the low-heat conductive film 15 may be provided in the entire circumferential direction of the outer peripheral surface of the cylinder liner 10 from the intermediate part in the axial direction of the cylinder liner 10 to the lower side end. The "low-heat conductive film 15" here is formed by the material capable of lowering the heat conductivity between the cylinder liner 10 and the block body 3 compared to the state where the low-heat conductive film 15 is not formed. Specifically, the low-heat conductive film 15 is configured by the sprayed layer of a ceramic material (alumina, zirconia or the like), the sprayed layer of the oxide and a ferrous material containing many pores, a layer of a mold release agent (the mold release agent for which vermiculite, hitasol and water glass are mixed, the mold release agent for which a liquid material with silicon as a main component and the water glass are mixed or the like) for die casting formed through coating, the layer of the coating agent (the coating agent in which diatomaceous earth is mixed as the main component, the coating agent in which graphite is mixed as the main component or the like) for die centrifugal casting formed through coating, the layer of a metallic coating formed through coating, the layer of a low adherence agent (the low adherence agent in which the graphite, the water glass and water are mixed, the low adherence agent in which boron nitride and the water glass are mixed or the like) formed through coating, the layer of a heat resistance resin formed through resin coating, a chemical conversion treatment layer (the chemical conversion treatment layer of phosphate, the chemical conversion treatment layer of magnetite or the like) formed through chemical conversion treatment or the like. When the high-heat conductive film 14 and the low-heat conductive film 15 are provided on the outer peripheral surface of the cylinder liner 10, while the heat at the part that easily receives the heat generated inside the cylinder bore 2 of the cylinder liner 10 (the part on the upper side of the intermediate part in the axial direction of the cylinder liner 10) is easily radiated through the high-heat conductive film 14 to the block body 3, heat radiation to the block body 3 from the part that does not easily receive the heat generated inside the cylinder bore 2 (the part below the intermediate part in the axial direction of the cylinder liner 10) is suppressed by the low-heat conductive film 15. Thus, a temperature distribution in the axial direction of the cylinder liner 10 can be brought closer to be uniform.

REFERENCE NUMERAL LIST

1: bore block
2: cylinder bore
3: block body
4: inter-bore passage
10: cylinder liner
11: groove part
11': groove part
12: positioning groove
13: projection
14: high-heat conductive film
15: low-heat conductive film
L1: virtual line
L2: virtual line
S1: outer peripheral surface
S2: inner peripheral surface

The invention claimed is:

1. A cylinder liner that is casted in an aluminum alloy block and defines a cylinder bore corresponding to one cylinder, comprising:

a cylindrical liner body;

a projection part provided so as to include a plurality of projections on an outer peripheral surface of a part of the liner body; and a bore adjacent part provided so as to be inclined at a predetermined angle to an axial direction of the liner body and to extend in the inclination direction, at a predetermined part between an upper side end and a lower side end of the liner body, of the outer peripheral surface of the liner body, which faces another cylinder bore to be adjacent when casted in the block, wherein the bore adjacent part is a groove formed such that the outer peripheral surface is positioned more on an inner side of the liner body than the outer peripheral surface above and below the bore adjacent part, and the projections are absent on at least a part of the outer peripheral surface, and in the projection part, a height of the projections is 0.2 mm to 0.7 mm, the number of projections is 10 pieces/$cm^2$ to 100 pieces/$cm^2$, and a projection area ratio calculated as a ratio occupied in a unit area by a total area of cross-sectional areas of the projections at the position of 0.2 mm from the base of the projections in the projections present within the unit area is 10% to 50%.

2. A cylinder liner according to claim 1, further comprising:

a positioning part provided so as to be at a predetermined relative position to the bore adjacent part such that the bore adjacent part is positioned at a predetermined position facing the other adjacent cylinder bore when casted in the block.

3. The cylinder liner according to claim 2, wherein the bore adjacent part is provided in a pair at one side face part and the other side face part positioned on an opposite side of the one side face part across a center axis of the liner body, at the predetermined part between the upper side end and the lower side end of the liner body, and the positioning part is provided on a part corresponding to at least one of the one side face part and the other side face part at the lower side end of the liner body.

4. The cylinder liner according to claim 3, wherein the positioning part is provided in a pair at respective lower parts of the one side face part and the other side face part at the lower side end of the liner body, and the bore adjacent parts and the positioning parts are provided such that a virtual line defined by connecting the bore adjacent parts provided in the pair and a virtual line defined by connecting the positioning parts provided in the pair cross at an angle of 0 degrees to 90 degrees in an upper view of the liner body.

5. The cylinder liner according to claim 4, wherein the virtual line defined by connecting the bore adjacent parts provided in the pair and the virtual line defined by connecting the positioning parts provided in the pair overlap in the upper view of the liner body.

6. The cylinder liner according to claim 1, wherein the bore adjacent part is two grooves to be line symmetrical to each other when a center line of the liner body is a reference in a side view of the liner body, and is formed in a shape of crossing the two grooves in a cross-hatch shape in a side view of the liner body.

* * * * *